US006093878A

United States Patent [19]

Hoshino

[11] Patent Number: 6,093,878

[45] Date of Patent: Jul. 25, 2000

[54] CLAMPING DEVICE FOR RODS FOR MUSICAL INSTRUMENTS

[75] Inventor: Yoshihiro Hoshino, Nagoya, Japan

[73] Assignee: Hoshino Gakki Co., Ltd., Japan

[21] Appl. No.: 09/386,054

[22] Filed: Aug. 30, 1999

[30] Foreign Application Priority Data

Jan. 25, 1999 [JP] Japan ..... 11-015802

[51] Int. Cl.[7] ..... G10D 13/02

[52] U.S. Cl. ..... 84/421; 84/422.3; 84/453; 248/122.1

[58] Field of Search ..... 84/421, 422.3, 84/453; 248/122.1

[56] References Cited

U.S. PATENT DOCUMENTS 4,047,684 9/1977 Kobayashi ..... 248/122.1
5,684,258 11/1997 Liao ..... 84/421

*Primary Examiner*—Stanley J. Witkowski
*Assistant Examiner*—Shih-yung Hsieh
*Attorney, Agent, or Firm*—Ostrolenk, Faber, Gerb & Soffen, LLP

[57] ABSTRACT

A clamp for rods which has a high degree of freedom of reorientation of angular position. A clamp main body has a first groove holder and a second rod holder. Connecting bolts each having an eye at one end, and a screw thread at the other end secure respective supporting rods in grooves formed on the clamp. An angle adjustment member has an annular engaging ring on one side that cooperates with a similar annular engaging ring on the clamp main body.

8 Claims, 9 Drawing Sheets

CLAMPING DEVICE FOR RODS FOR MUSICAL INSTRUMENTS

BACKGROUND OF THE INVENTION

1. Field of the Invention

The present invention relates to a clamp for musical instruments.

2. Description of the Related Art

A prior art musical instrument clamping arrangement is shown in FIGS. 10 and 11. Main cymbal S1 and auxiliary cymbal S2 are arranged on a cymbal stand ST. Using the prior art arrangement, the space to be occupied by a drum set can be reduced. Also, the arrangement is easier to carry around as compared with a setup in which each cymbal is installed on its own support stand.

An angle adjusting pivot 60 is employed in the arrangement of the auxiliary cymbal S2 to connect a connecting rod 71 and a cymbal rod 72 at a freely adjustable angle. This enables the auxiliary cymbal S2 to be positioned at various angles and positions.

In FIG. 10, a holding rod 75 supports the main cymbal S1, and a link 76 links holding rod 75 to the music stand ST.

In the prior art construction in which the auxiliary cymbal S2 is positioned by the angle adjusting pivot 60, however, the range of motion of the auxiliary cymbal S2 is limited to an arc with the angle adjusting pivot 60 as its center, as indicated by a chain line Q in FIG. 11. The adjustability in the prior art arrangement of the positions of the main cymbal S1 and the auxiliary cymbal S2 are undesirably restricted.

SUMMARY OF THE INVENTION

The present invention overcomes the above deficiencies of the prior art, by providing a simple clamp for musical instruments by which the position of a musical instrument is freely adjustable with a greater degree of freedom.

The inventive clamp includes a main body having a connecting rod holder that is equipped with a groove that holds a connecting rod. A hole is formed in the connecting rod holder extending in a direction that intersects the groove at a right angle.

A connecting bolt passes through the hole of the connecting rod holder. The connecting bolt has an eye disposed on a head end of the bolt for receiving the connecting rod and has a screw thread formed on the other end. The screw thread passes through the hole of the clamp main body, and receives a nut screwed on the outside of the hole. Consequently, the connecting rod inserted into the eye is fixed to the groove of the connecting rod holder of the clamp main body.

The inventive clamp also includes a musical instrument rod holder formed on the main body. The holder is equipped with an annular ring through which an opening is formed. One side of the angle adjusting hub engages the annular ring on the instrument rod holder. A groove disposed on the other side of the angle adjusting hub holds the instrument rod in a manner similar to the way the groove of the connecting rod holder clamps to the connecting rod.

The angle adjusting hub is held onto the annular ring of the instrument rod holder by an aperture formed through the angle adjusting hub. The aperture extends in a direction orthogonal to the groove in the angle adjusting hub and intersects the groove. An instrument securing bolt fits through the aperture. The bolt has an eye for the instrument rod which is formed in the head end of the bolt and a screw thread formed at the other end of the bolt. The screw thread, inserted through the aperture of the angle adjustment hub, passes through the opening in the annular ring of the clamp main body. A nut threaded onto the screw secures to the outside of the opening. The instrument rod inserted into the eye of instrument securing bolt is thereby fixed to the angle adjusting hub, and the angle adjusting hub is fixed to the instrument rod holder of the clamp main body.

In addition, the invention relates to a clamp for musical instruments, wherein the groove that holds the connecting rod of the clamp main body includes a second, orthogonal groove.

Other features and advantages of the present invention will become apparent from the following description of the invention which refers to the accompanying drawings.

DETAILED DESCRIPTION OF THE PREFERRED EMBODIMENTS

Figure 1:
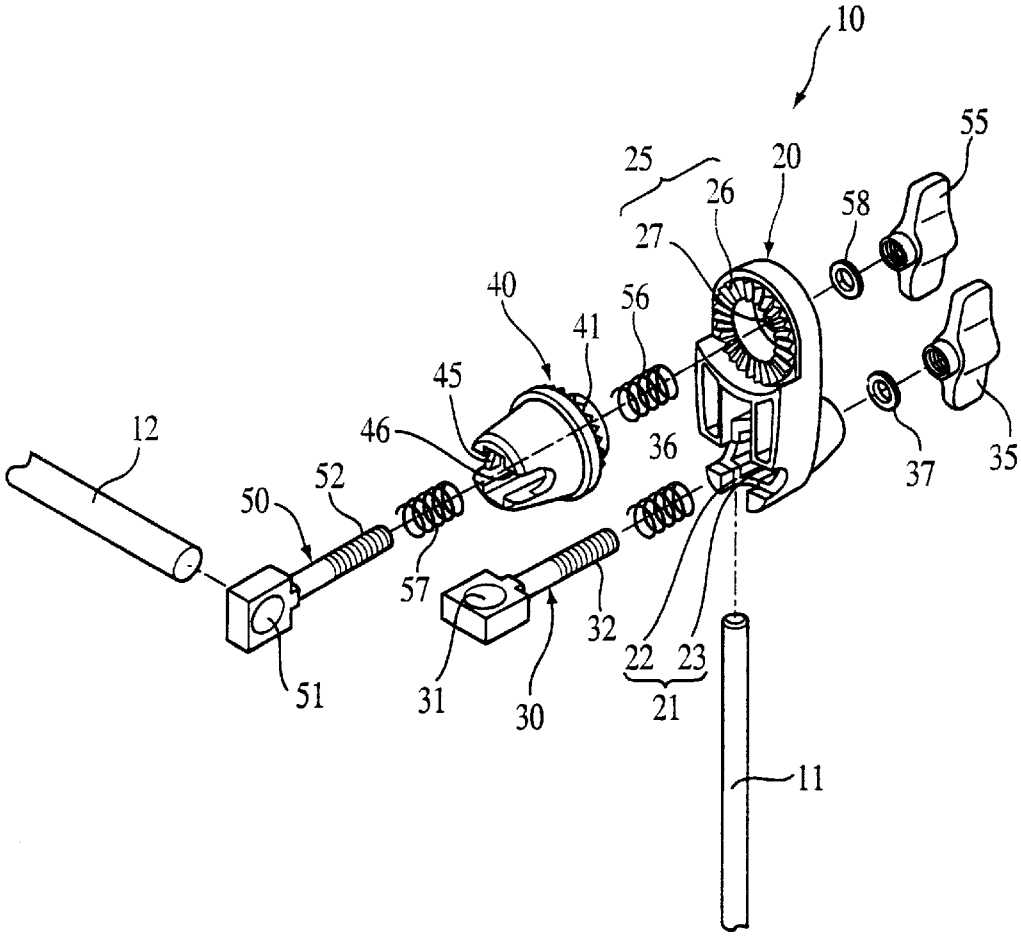
FIG. 1 is a view of a clamp for musical instruments including a first embodiment of the invention.

FIG. 1 shows an exploded view of a clamp 10 for musical instruments according to the present invention. Clamp 10 is comprised of a main body 20, through which a connecting bolt 30 passes, and an angle adjusting hub 40, through which an instrument securing bolt 50 passes. The clamp 10 connects between a connecting rod 11 and a cymbal support rod 12, for example.

The main body 20 has a lower connecting rod holder 21 and an upper instrument rod holder 25. The connecting rod holder 21 holds the connecting rod 11 in the clamp. The holder comprises a groove 22 and an aperture 23 formed through main body 20.

Figure 4:
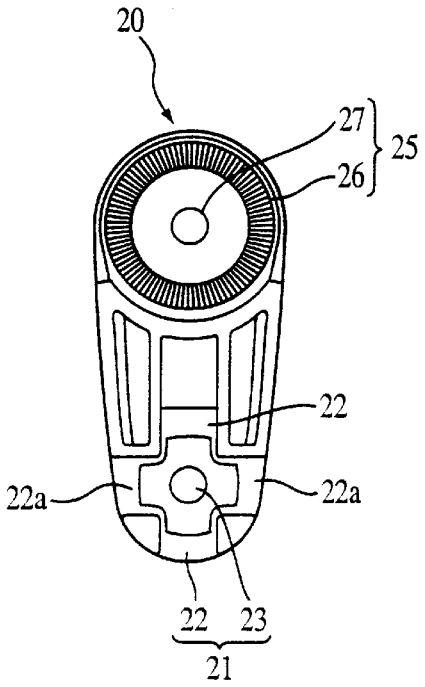
FIG. 4 is a side view of the clamp main body.

The groove 22 is formed approximately in the shape of either a V or a U. In this example, two orthogonal grooves are provided for alternatively holding an instrument rod at orthogonal orientations, as shown in FIG. 4. The two grooves include a holding groove 22*a* formed in the horizontal direction and another holding groove 22 is formed in the vertical direction.

The lower aperture 23 receives connecting bolt 30, as described below. The aperture 23 extends orthogonally to and intersects the groove 22 (and 22*a*, when present). In this example, aperture 23 is formed at the intersection of the grooves 22 and 22*a*.

In FIG. 1, at the upper end of the main body 20, instrument rod holder 25 cooperatively engages angle adjustment hub 40 for holding cymbal rod 12 to the clamp. Instrument rod holder 25 comprises an annular ring 26, which surrounds an opening 27 through the main body 20.

The annular ring 26 engages a complementary annular ring 41 on the angle adjustment hub 40 as described below. The two rings may engage at virtually any rotation angle. The complementary rings are formed by alternating concave and convex portions or complementary teeth arranged oriented radially.

The opening 27 receives an instrument securing bolt 50, described below. The opening 27 extends in a direction that runs through the center of the annular ring 26.

On the lower part of main body 20, connecting bolt 30 secures the connecting rod 11 at the groove 22 or 22*a*. Bolt 30 has an eye 31 at its head end and screw thread 32 at the other end. Eye 31 accepts the connecting rod 11 and is of such a size as will make it possible for the connecting rod to be inserted into the central portion of the head of bolt 30, which is approximately the shape of a rectangular parallelepiped.

Once connecting rod 11 has been inserted and is held in connecting bolt 30 through eye 31, screw thread 32 is inserted into the aperture 23 from the side of the groove 22 of the clamp main body 20. The connecting bolt is secured to the main body by a nut 35 which is outside the aperture 23. As the nut 35 is tightened, the connecting rod 11 is held and fixed within the eye 31 and against the groove 22 of the clamp main body 20. Referring to FIG. 1, a spring 36 on the groove side of the body 20 and a washer 37 at the other side combine to provide smooth tightening and loosening operation of the connecting rod holder.

Figure 2:
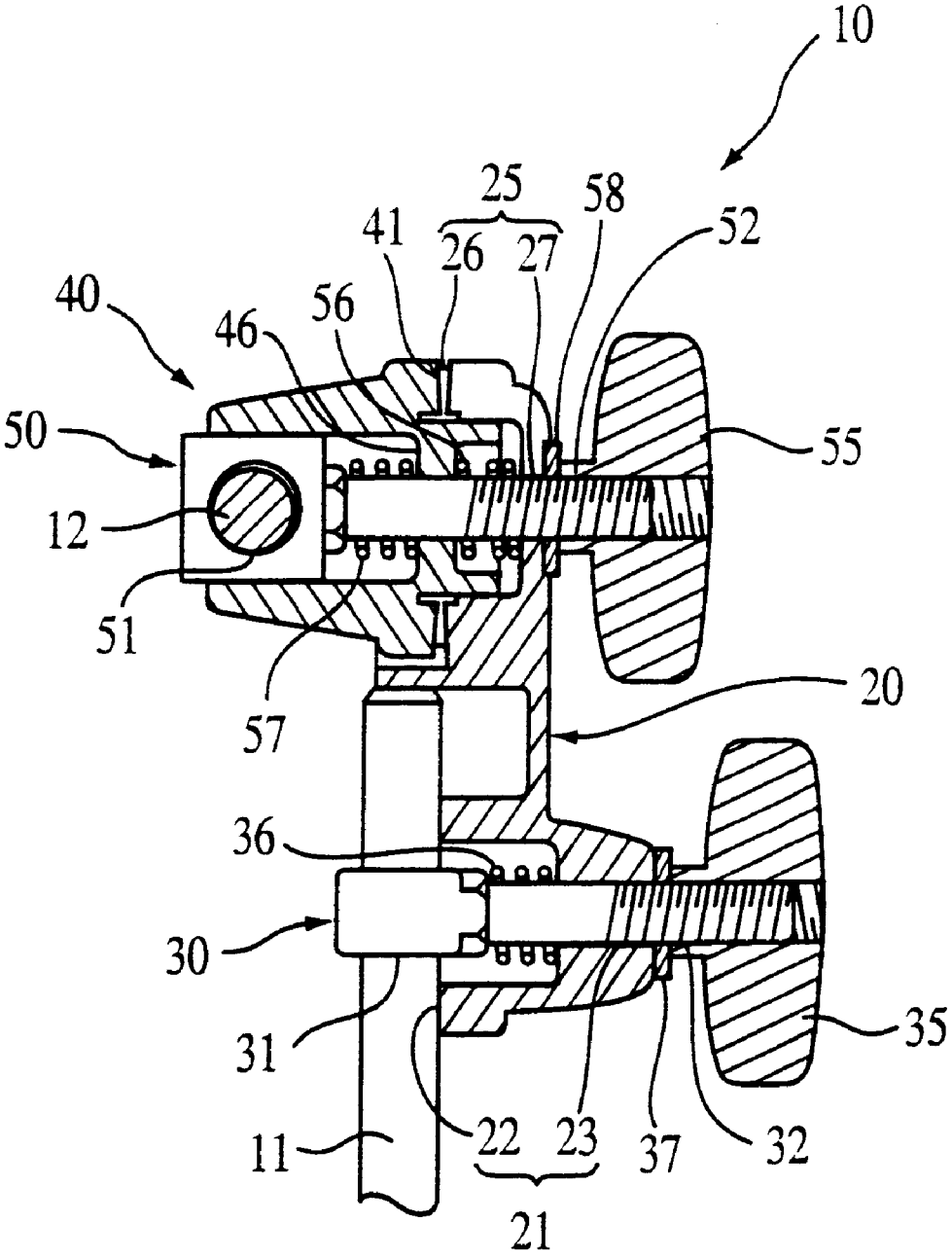
FIG. 2 is a cross section of the clamp for musical instruments, wherein the connecting rod is held in a longitudinal direction.
Figure 3:
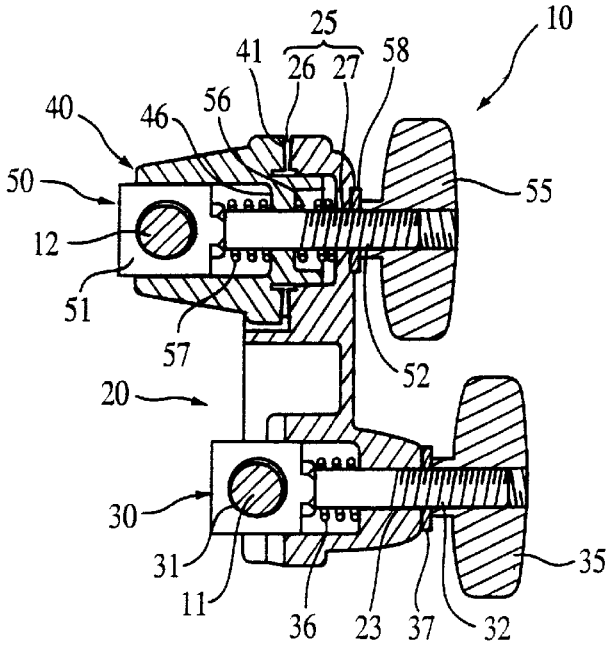
FIG. 3 is a cross section of the clamp for musical instruments, wherein the connecting rod is held in a horizontal direction.

As the grooves 22 and 22*a* are formed in a cross, it is possible for the connecting rod 11 to be held either in the vertical direction, as in FIG. 2, or in the horizontal direction, as in FIG. 3. Both of the side groove 22*a* of the groove 22 are open at their ends. Consequently, connecting rod 11 is slidable above the length of the grooves 22 and 22*a*, and the connecting rod can be fixed to the groove 22 at any selected position along the length of the rod.

Figure 5:
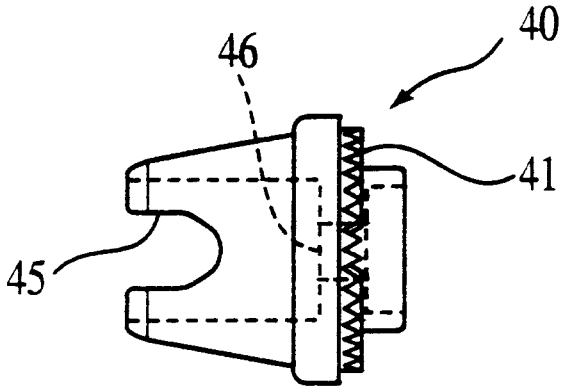
FIG. 5 is a side view of the angle adjustment hub.
Figure 6:
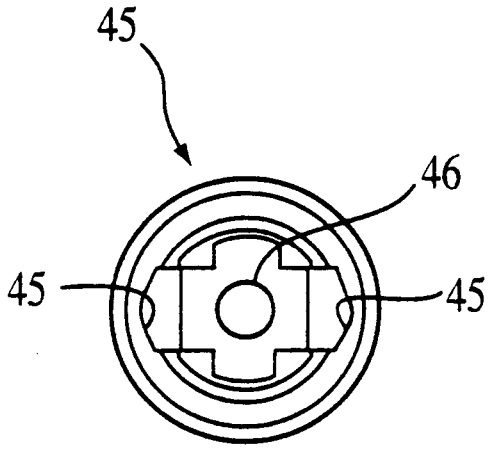
FIG. 6 is a front view of the angle adjustment hub.

On the upper end of main body 20, the angle adjusting hub 40 has an annular ring 41 on one side and a groove 45 on the other side as is shown in FIG. 1 and in FIGS. 5 and 6. Hub 40 includes a through hole 46 formed through the center of the annular engaging part 41 and in an orthogonal direction that intersects groove 45.

Annular ring 41 on the hub 40 engages the annular ring 26 of the clamp main body member 20 at any selected rotative angle. Facing surfaces of the rings are complementary, being constituted, for example, by a radially oriented set of teeth sized and shaped for suitable complementary engagement.

On the opposite side of the annular ring 41 of the angle adjusting hub 40, the groove 45 is provided for holding the rod 12 for a cymbal, for example. The groove 45 is approximately V- or U-shaped. The instrument securing bolt 50 extends in a direction which crosses the groove 45 at a right angle and extends through the center of the annular ring 41.

In the preferred embodiment, the instrument securing bolt 50 is substantially identical to the connecting bolt 30, and they may be interchangeable. An eye 51 is equivalent to the eye 31 of the connecting bolt 30. Similarly, screw thread 52 is equivalent to screw thread 32.

To support an instrument, screw 52 is inserted into the through hole 46 of the angle adjustment hub 40 and into the aperture 27 of the clamp main body 20. The nut 55 is screwed onto screw thread 52 outside of the aperture 27. A cymbal rod 12 is inserted into the eye 51.

As the nut 55 is tightened, the cymbal rod 12 is fixed within the eye 51 of the instrument securing bolt 50 and in the groove 45 of the angle adjustment member 40. This also secures the annular ring 41 to the annular ring 26 of the clamp main body member 20 and enables the annular engaging part 41 of the angle adjustment member 20 to be located at a prescribed angular orientation. Spring 56 between bodies 20 and 40 and spring 57 between both head 51 and body 40 and washer 58 enhance the operation of the device.

In installation of the cymbal rod 12, a free angular orientation is permitted by the engagement between the annular ring 41 of the angle adjustment hub 40 and the annular ring 26 of the main body 20. At the same time, as the notch 45 has both of its ends open, at the right and at the left, the clamp may be fixed at any suitable position along the length of the cymbal rod 12 and the rod may be set at any length.

Figure 7:
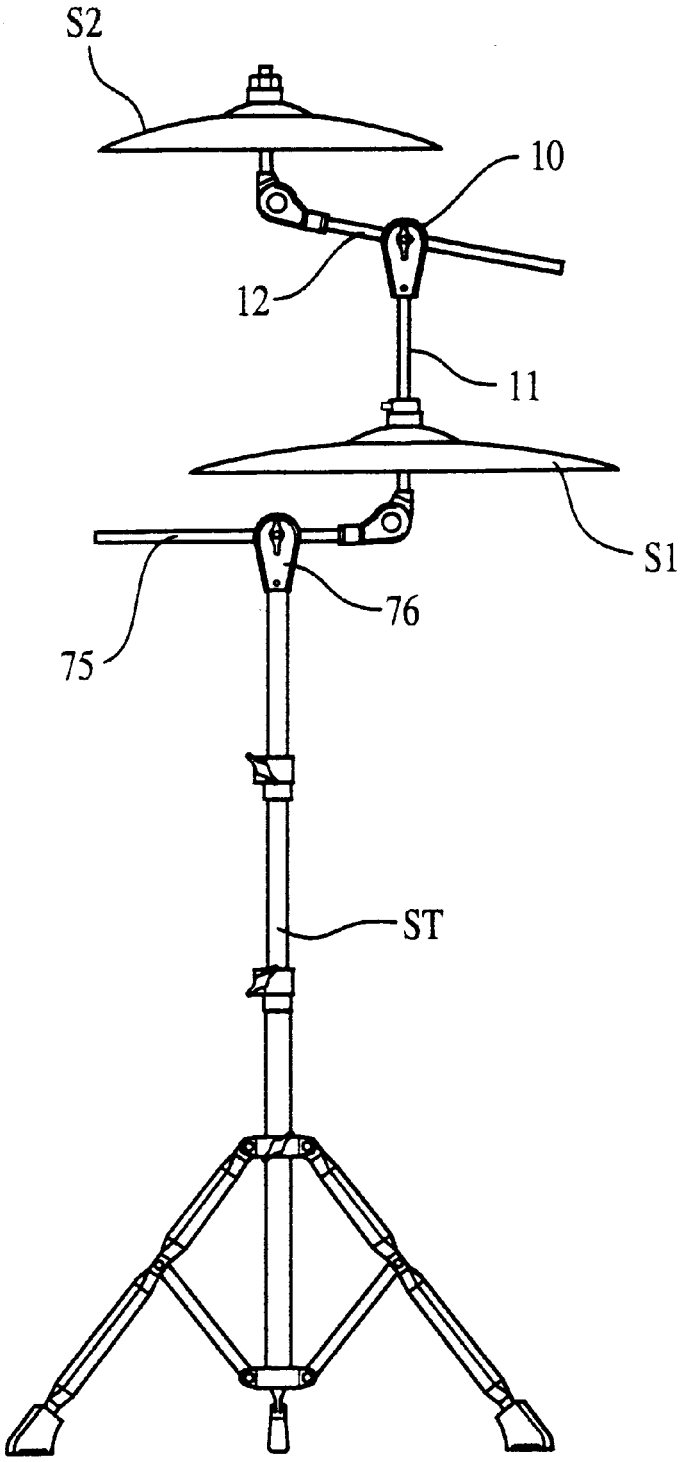
FIG. 7 is a front view of a stand for musical instruments showing an example of the use of the clamp for musical instruments according to the invention.
Figure 8:
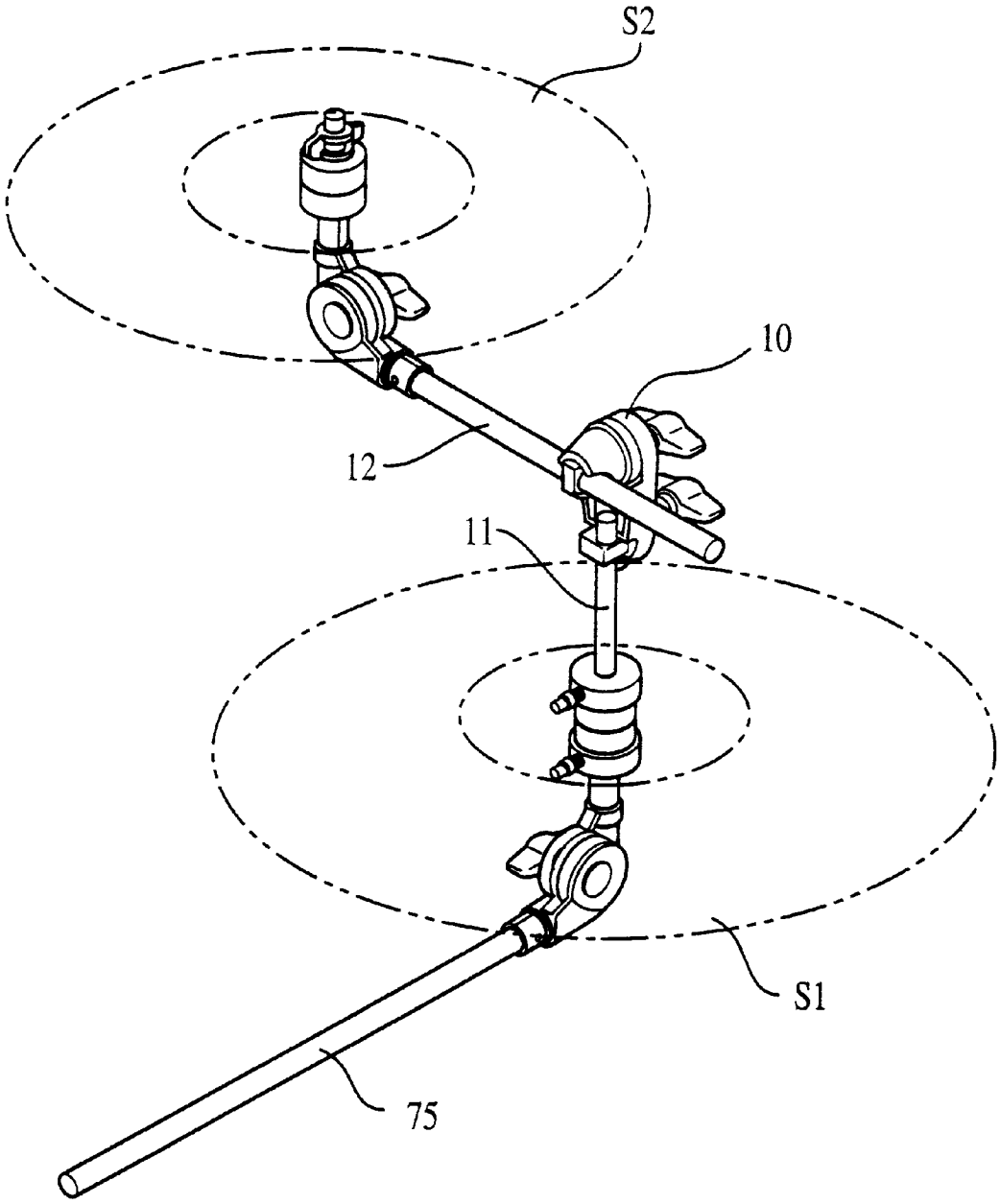
FIG. 8 is an expanded oblique view detailing the clamp arrangement of FIG. 7.

FIGS. 7 and 8 illustrate a cymbal arrangement using the musical instrument clamp of the present invention. In this example, the auxiliary cymbal S2 is arranged with the main cymbal S1. The cymbals are held on a musical instrument stand ST described earlier. Clamp 10 is secured between connecting rod 11 extending above the main cymbal S1 and the holding rod 12 supporting the auxiliary cymbal S2.

In FIGS. 7 and 8, the angle and length positions of the cymbal rod 12 can be freely adjusted by the clamp according to the invention. Therefore, it becomes possible to position the auxiliary cymbal S2 in a manner convenient to the performer.

Figure 9:
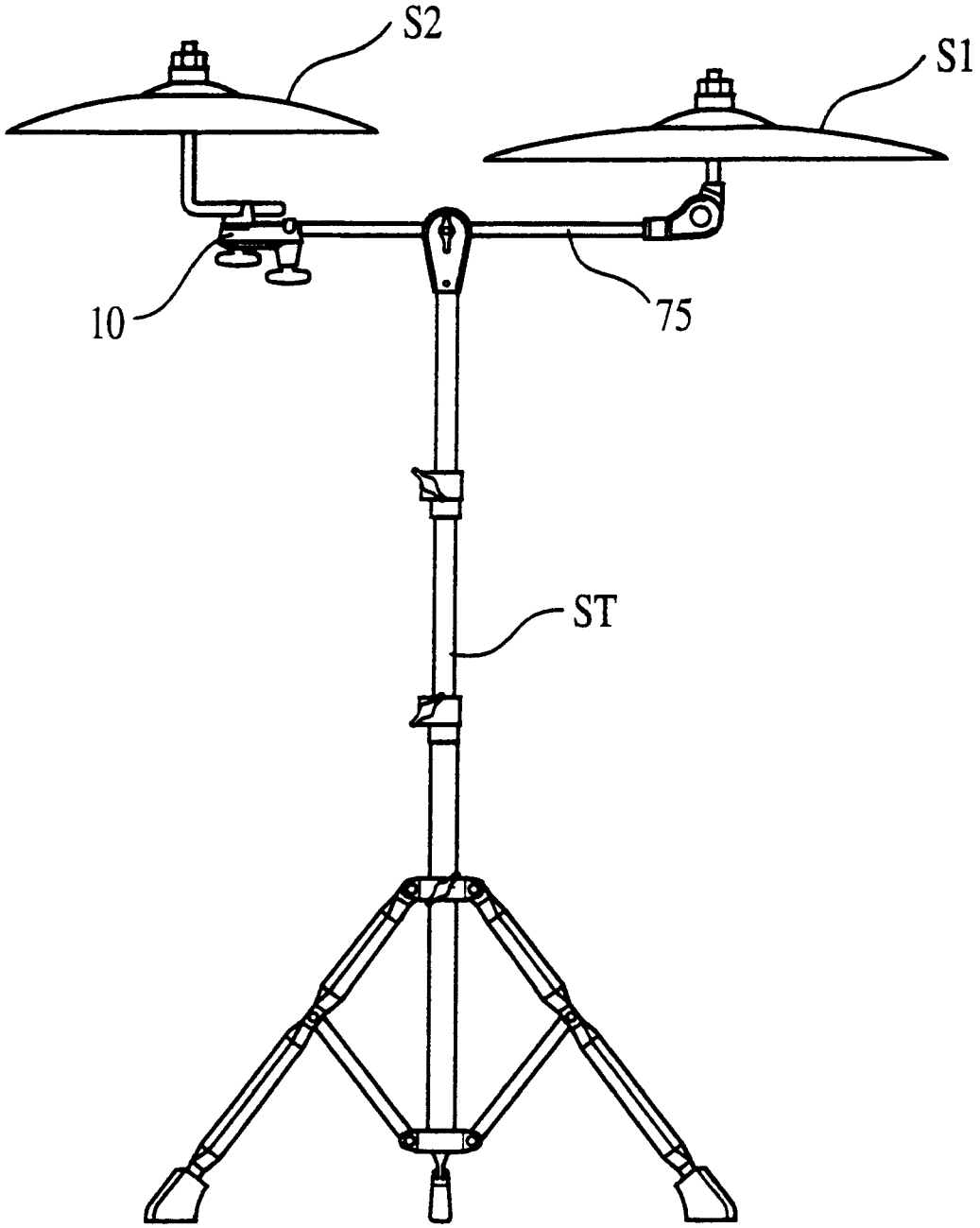
FIG. 9 is an elevation of a musical instrument stand showing an example of another usage of the clamp for the musical instruments according to the invention.
Figure 10:
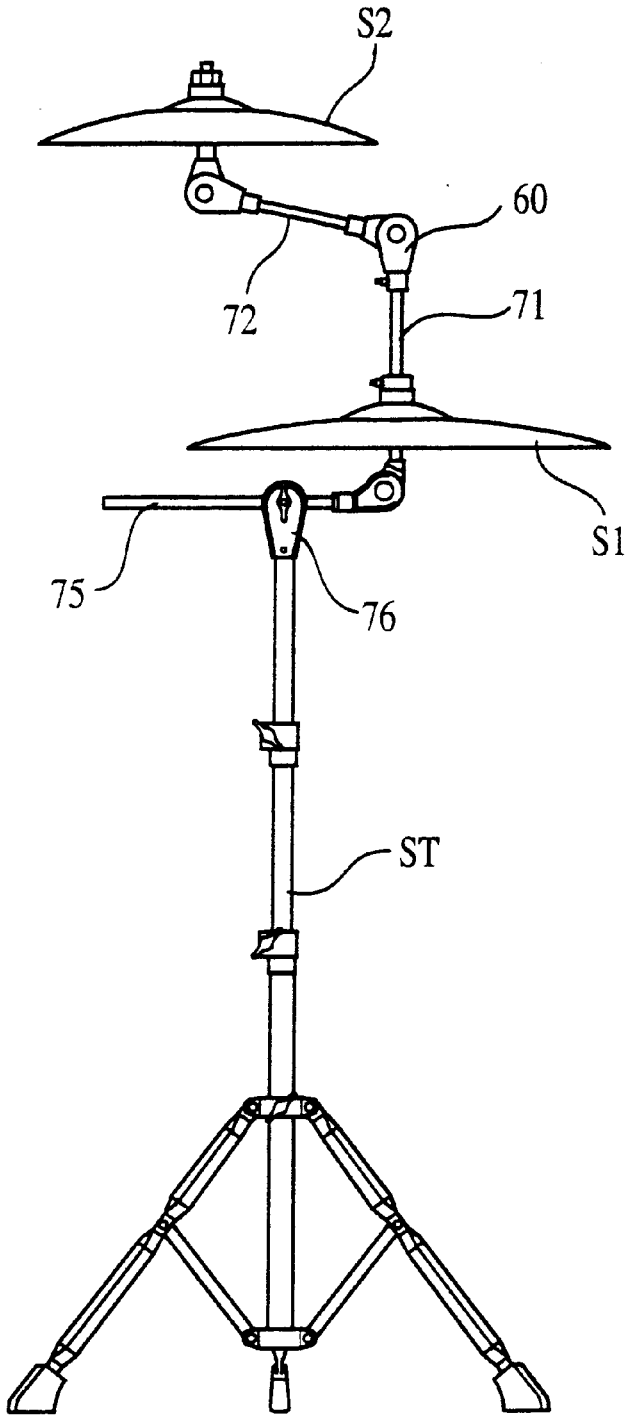
FIG. 10 PRIOR ART
FIG. 10 is an elevation of a prior art musical instrument stand and clamp.
Figure 11:
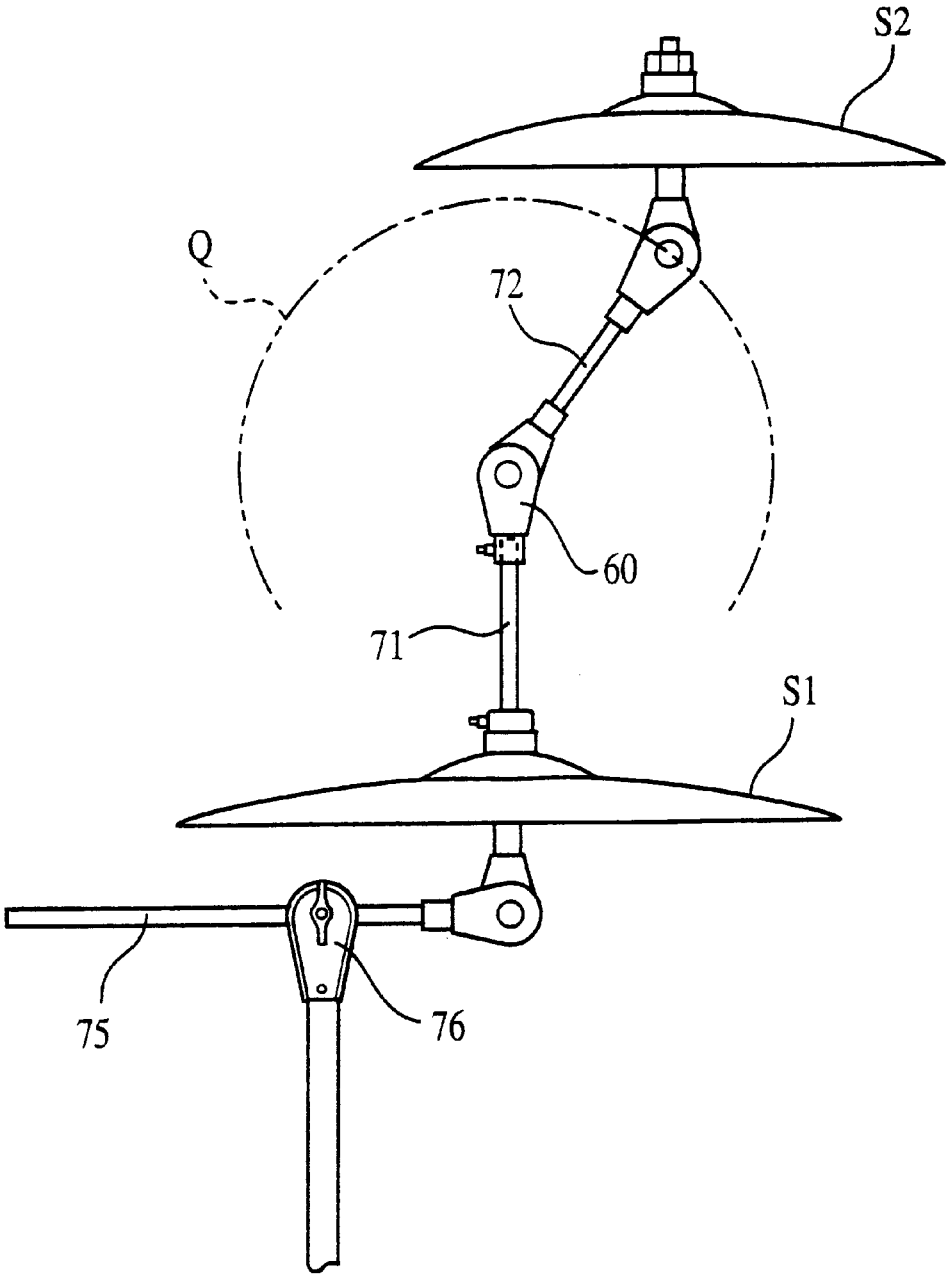
FIG. 11 PRIOR ART
FIG. 11 is a detailed view of the prior art musical instrument stand and clamp of FIG. 10.

In addition, the auxiliary cymbal S2 can be arranged on the side by using the clamp 10 of the invention in conjunction with holding rod 75 of the main cymbal S1, as shown in FIG. 9.

The clamp for musical instruments of the invention as explained above enables the position to be adjusted with a high level of freedom by using an extremely simple construction, thereby making it possible for the position for the musical instrument that is installed to be adjusted freely. Because the adjustment of the angle position of the cymbal rod and its length can be carried out simultaneously by operation of the instrument tightening member of this invention, the operation involved is simple and the construction can be compact.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A clamp for rods comprising:

a main body having a first side with a first groove for holding a first connecting rod, a first opening through the body extending in a direction which crosses the first groove;

an angle adjustment hub formed on the main body and having a first annular ring thereon and a second opening therethrough; and a rod holder having a second side with a second annular ring thereon that engages the first annular ring of the main body at any selected rotative angle between the first and second annular rings, a third opening through the rod holder extending in a direction through the second annular ring;

the rod holder having a third side away from the second side; a second groove in the third side for holding a second rod on the third side, the third opening through the rod holder extending in a direction through the second groove and through the second annular ring;

a first securing bolt having a first eye therein for receiving the first rod and a first screw thread formed at an end of the first bolt away from the first eye, the first thread being passed through the first opening in the main body, a first nut being screwed onto the first thread outside the first opening, screwing the first nut on the first thread draws the rod in the first eye to the first groove of the main body;

a second securing bolt having a second eye therein for receiving the second rod at and a second screw thread at an end of the second bolt away from the second eye, the second screw thread being inserted through the second opening of the angle adjustment hub of the main body, and a second nut tightened on the second thread of the second bolt outside of the second opening such that the second rod in the second eye is held in the second groove of the rod holder and the rod holder is fixed in rotation to the main body by tightening the second nut on the second thread.

2. The clamp of claim 1, further comprising another groove on the first side of the main body and oriented at an angle to the first groove.

3. The clamp of claim 2, wherein the first and the other grooves on the main body are orthogonal.

4. The claim of claim 1, wherein the first opening crosses the first groove at a right angle.

5. The clamp of claim 1, wherein the third opening crosses the second groove at a right angle.

6. The clamp of claim 1, wherein the third opening crosses the second groove at a right angle.

7. The clamp of claim 1, wherein the first rod is a supporting rod and the second rod is connectable to a musical instrument for supporting the instrument.

8. The clamp of claim 1, wherein the first and second annular rings comprise respective sets of teeth which engage when the second nut is tightened to prohibit relative rotation between the main body and the hub.

* * * * *